US008397406B2

(12) United States Patent
Glassman et al.

(10) Patent No.: US 8,397,406 B2
(45) Date of Patent: Mar. 19, 2013

(54) SYSTEM AND METHOD FOR USING COLOR TO INDICATE A STATE OF A HOME APPLIANCE, SUCH AS AN IRON

(75) Inventors: Ellen Glassman, Closter, NJ (US); David Farrage, Demarest, NJ (US)

(73) Assignee: Sears Brands, L.L.C.

( * ) Notice: Subject to any disclaimer, the term of this patent is extended or adjusted under 35 U.S.C. 154(b) by 286 days.

(21) Appl. No.: 12/728,389

(22) Filed: Mar. 22, 2010

(65) Prior Publication Data

US 2011/0225858 A1 Sep. 22, 2011

(51) Int. Cl.
*D06F 75/26* (2006.01)
*D06F 75/00* (2006.01)

(52) U.S. Cl. ..... 38/75; 38/77.8; 219/248

(58) Field of Classification Search ..... 38/75, 77.2, 38/88, 77.8; 219/248; 362/89
See application file for complete search history.

(56) References Cited

U.S. PATENT DOCUMENTS

| | | | | |
|---|---|---|---|---|
| 2,883,779 | A * | 4/1959 | Krause et al. | 38/77.2 |
| 3,676,950 | A * | 7/1972 | Clarke | 446/474 |
| 3,903,625 | A * | 9/1975 | Augustine | 38/77.2 |
| 4,291,836 | A * | 9/1981 | Chen-Hsiung | 239/37 |
| 4,532,411 | A | 7/1985 | Terraillon et al. | |
| 4,642,922 | A | 2/1987 | Prudenziati | |
| 5,117,092 | A | 5/1992 | Shimizu | |
| 5,493,799 | A * | 2/1996 | Foo | 38/16 |
| 6,540,168 | B1 | 4/2003 | Archer et al. | |
| 6,548,785 | B1 * | 4/2003 | Rius et al. | 219/248 |
| 6,676,271 | B2 * | 1/2004 | Kohn et al. | 362/101 |
| 6,986,218 | B1 | 1/2006 | Choy et al. | |
| 7,395,619 | B2 | 7/2008 | Lee | |
| 7,546,701 | B2 | 6/2009 | Alipour | |
| D608,068 | S | 1/2010 | Choi | |
| 2003/0159588 | A1 * | 8/2003 | Croll | 99/275 |
| 2006/0081588 | A1 * | 4/2006 | Bowser et al. | 219/248 |

FOREIGN PATENT DOCUMENTS

EP 1008687 A1 6/2000

OTHER PUBLICATIONS

Westinghouse ThermoColor Color Changing Iron, http://www.orangeonions.com/product/WST5017/Westinghouse-ThermoColor-Color-Cha . . . , Apr. 26, 2010.

* cited by examiner

*Primary Examiner* — Ismael Izaguirre
(74) *Attorney, Agent, or Firm* — McAndrews, Held & Malloy, Ltd.

(57) ABSTRACT

A system and method for using color to indicate a state of a home appliance, such as an iron. The iron has a sole plate and a water tank in fluid communication with the sole plate, a heater for heating the sole plate, a sensor for sensing a temperature of the sole plate, a user interface for setting a desired temperature for the sole plate, and a controller in communication with user interface and the sensor for controlling the heater. An illumination device under the control of the controller is provided to illuminate the water tank, particularly the interior thereof, in a color that is representative of a state of the iron, such as a power condition of the iron and/or a temperature of the sole plate.

8 Claims, 3 Drawing Sheets

SYSTEM AND METHOD FOR USING COLOR TO INDICATE A STATE OF A HOME APPLIANCE, SUCH AS AN IRON

BACKGROUND

In the art it is known to provide irons with heated sole plates where heating energy is provided by a thermostatically controlled electric element and the temperature of the sole plate is selected by a user to suit the nature of clothing to be ironed. It is additionally known to provide an iron with a water tank whereby water can be admitted from the water tank to outlets of the sole plate whereupon it vaporizes and issues as steam. By way of example, U.S. Pat. No. 7,395,619, entitled "Steam Iron," describes a steam iron having a body, a water tank, a sole plate, and a controlled device, such as an electrical solenoid valve, operable to release water from the water tank through outlets of the sole plate. A heat sensor is used to continuously monitor the temperature of the sole plate and to provide an output signal that is used to control the controlled device whereby the amount of water admitted from the water tank to the sole plate will be in accordance with the temperature of the sole plate.

By way of further example, U.S. Pat. No. 5,117,092, entitled "Cordless Iron," describes an iron body having a heatable sole plate. An electrically powered temperature sensor senses the temperature of the sole plate of the iron body and outputs a signal representative of that sensed temperature. An alarm device responsive to the signal outputted from the temperature sensor serves to indicate that the sensed temperature drops to or below a reference temperature.

Methods for manufacturing steam irons are also known in the art. By way of example, U.S. Pat. No. 6,986,218, entitled "Method Of Connecting A Housing Part And Water Tank Parts Of An Iron," describes a method of connecting a housing part of an iron to a water tank of the iron. The water tank includes a top part and a bottom part that are connected through use of a watertight connection. An edge of the housing part, an edge of the top part of the water tank, and an edge of the bottom part of the water tank are then connected to each other in a single process step by means of mirror welding.

Yet further examples of irons and method for manufacturing the same may be seen in U.S. Pat. No. 7,546,701, entitled "Automatic Standby Electric Iron," U.S. Pat. No. 6,540,168, entitled "Retractable Cord Assembly," EP Publication No. 1 008 687, entitled "Improved Iron," U.S. Pat. No. 4,532,411, entitled "Electric Fabric Steaming Appliance Having A Detachable Sole Plate," U.S. Pat. No. 4,642,922, entitled "Removable Steam Iron Sole Plate," and U.S. Pat. No. D608, 068, entitled "Electric Iron."

For the sake of brevity of disclosure, each of these publications is incorporated herein by reference in its entirety.

SUMMARY

A novel appliance, such as an iron, that uses color to indicate an appliance state is hereinafter described. Generally, the iron has a sole plate and a water tank in fluid communication with the sole plate, a heater for heating the sole plate, a sensor for sensing a temperature of the sole plate, a user interface for setting a desired temperature for the sole plate, and a controller in communication with user interface and the sensor for controlling the heater. An illumination device under the control of the controller is provided to illuminate the water tank, particularly the interior thereof, in a color that is representative of a state of the iron, such as a power condition of the iron and/or a temperature of the sole plate.

A better understanding of the objects, advantages, features, properties and relationships of the novel system and method for using color to indicate a state of an iron will be obtained from the following detailed description and accompanying drawings which set forth an illustrative, preferred embodiment indicative of the various ways in which the principles of the invention may be employed.

BRIEF DESCRIPTION OF THE DRAWINGS

For a better understanding of the system and method for using color to indicate a state of an iron hereinafter described reference may be had to the following drawings in which.

DETAILED DESCRIPTION

Figure 1:
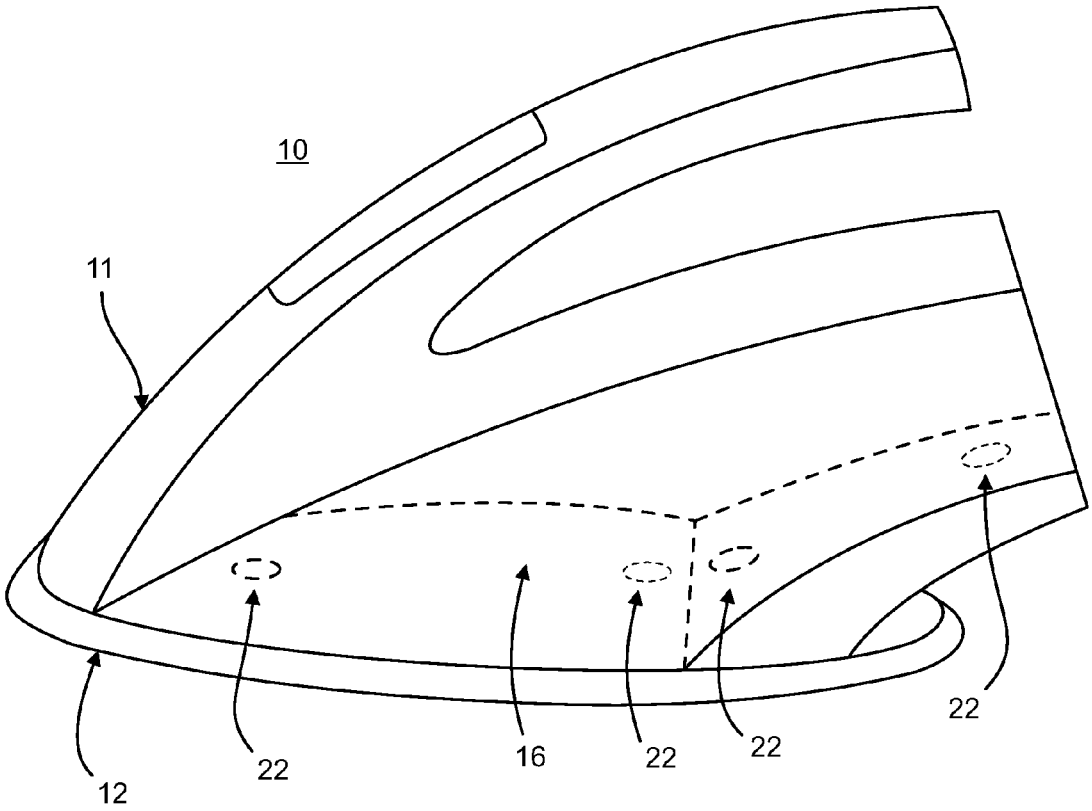
FIG. 1 is a view of an exemplary iron that uses color to indicate state.
Figure 2:
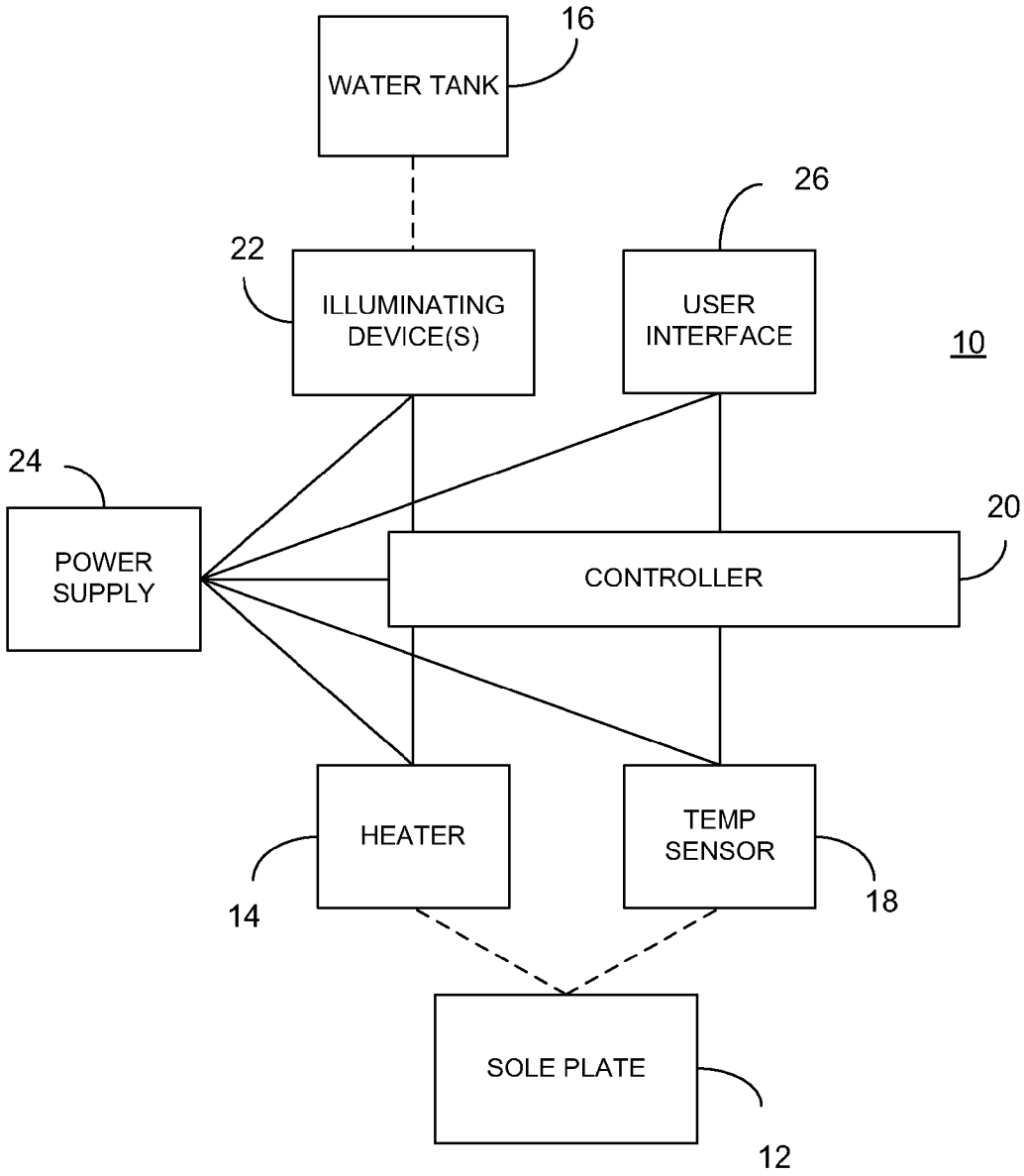
FIG. 2 is a block diagram of exemplary components of the exemplary iron shown in FIG. 1.
Figure 3:
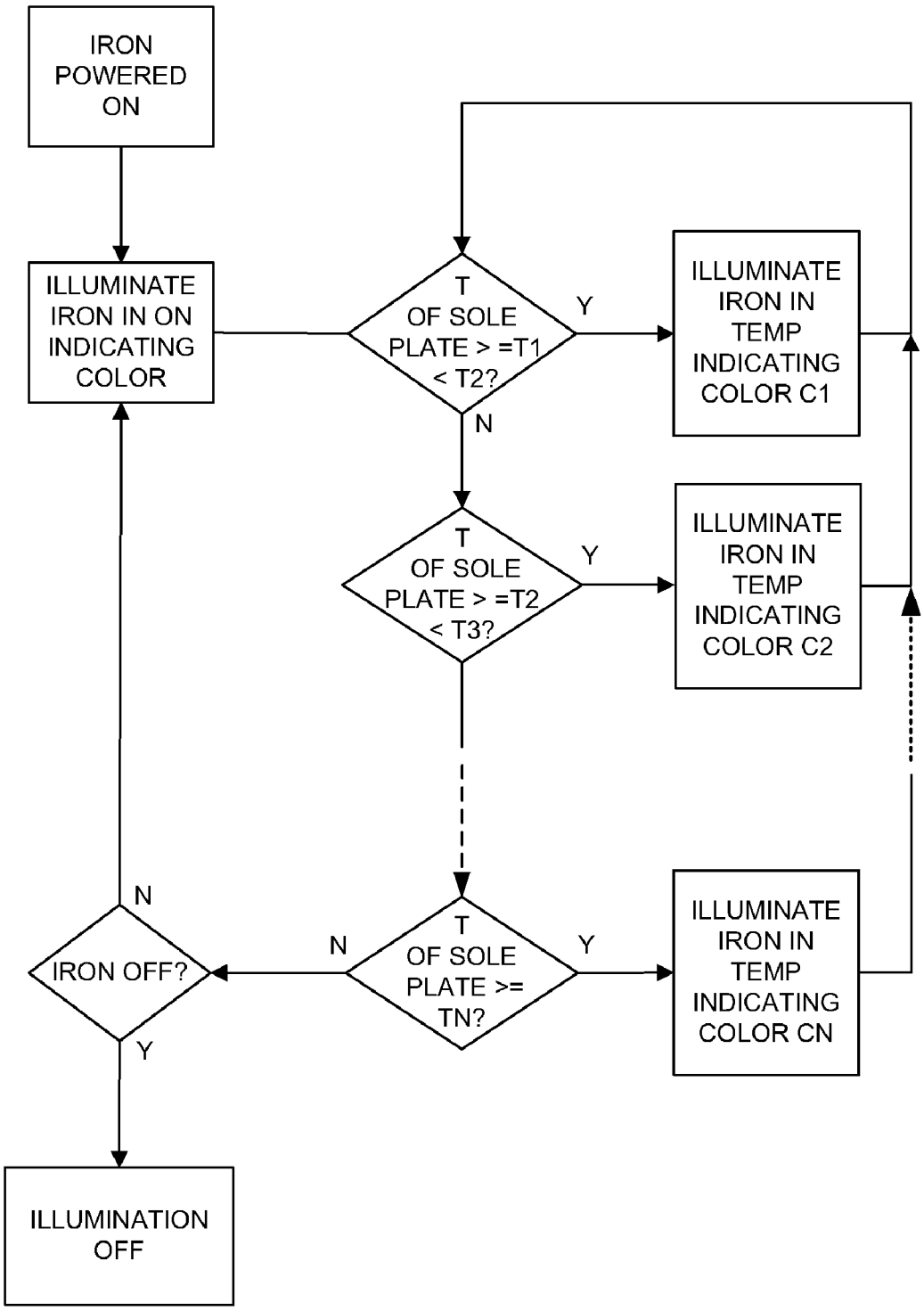
FIG. 3 is a flow chart diagram illustrating steps for illuminating the exemplary iron of FIGS. 1 and 2 to indicate state.

Referring now to the FIGS. 1-3, an appliance, in the exemplary form of an iron 10 that uses color to indicate state, such as a power condition and/or temperature of a sole plate, is hereinafter described. Generally, the iron 10 has an iron body 11 to which is attached a sole plate 12. A heater 14 serves to heat the sole plate 12. The iron body 11 additionally includes a water tank 16 for storing water. The water tank 16 extends above the sole plate 12. Generally, the water tank 16 communicates with a vaporizing chamber to feed water to the vaporizing chamber which, in turn, allows for the production of steam whereby steam may be admitted through openings in the sole plate 12 as desired.

The iron body 11 further includes a temperature sensor 18, such as a thermistor, for sensing a temperature of the sole plate 12. An output signal from the temperature sensor 18 is processed by a controller 20, such as a microprocessor, contained in the iron body 11. One or more illuminating devices 22, such as light emitting diodes (LEDs)—which may be single colored LEDs or multicolored LEDs illuminable alone and/or in combinations to provide a range of colors as desired, are contained in the iron body 11. The one or more illuminating devices 22, in communication with the controller 20, are preferably positioned within the iron body 11 so as to illuminate the water tank 16. In this regard, the water tank 16 may be constructed of a transparent or translucent material (collectively referred to hereinafter as "translucent material") with the one or more illuminating devices 22 serving to illuminate the interior of the water tank. In this manner, light produced by the one or more illuminating devices 22 will be visible to a user looking at the water tank 16. By way of example only, the illuminating devices 22 may be positioned adjacent to a side of the water tank 16, e.g., the underside, and may be oriented so as to illuminate water that is stored within the water tank 16. It will also be appreciated that the one or more illuminating devices 22 can be arranged within the walls of the water tank 16 itself and be oriented so as to directly illuminate the interior of the walls of the water tank 16 without limitation. The controller 20, heater 14, and other electrical devices of the iron 10 will be powered by a power supply 24. The power supply 24 can be converted AC power, a rechargeable DC battery, or the like without limitation.

The iron body 11 additionally includes a user interface 26, such as a dial, switches, touch pad, or the like, whereby a user can set a desired temperature for the sole plate 12. The user interface 26 is in communication with the controller 20 which, as noted above, also receives the output signal from the temperature sensor 18. In this manner, the controller 20 controls the supply of the electric power to the heater 14 in accordance with the output signals from the temperature sensor 18 and the user interface 26 to regulate the temperature of the sole plate 12 at a desired temperature setting. In addition, the controller 20 functions to control illumination of the one or more illuminating devices 22, for example, in accordance with power state of the iron and/or the output signal from the temperature sensor 18.

By way of more particular example, the controller 20 may optionally function to cause the one or more illuminating devices 22 to illuminate the water tank 16 with on indicating color, e.g., blue, when the iron is powered on. The controller 20 may additionally or alternatively function to cause the one or more illuminating devices 22 to illuminate the water tank 16 with a temperature indicating color (which would be different than the on indicating color if used), e.g., orange, when the controller 20 determines, from the output signal received via the temperature sensor 18, that the sole plate 12 has reached a predetermined temperature. As desired, the controller 20 can also, optionally function to cause the one or more illuminating devices 22 to illuminate the water tank 16 with additional temperature indicating colors when the controller 20 determines, from the output signal received via the temperature sensor 18, that the sole plate 12 has reached further, predetermined temperatures. As still further shown in FIG. 3, if the iron 10 is still powered on and a temperature of the sole plate 12 is (or becomes) less than a predetermined temperature that causes a temperature indicating color illumination of the water tank 16, the water tank 16 will be continue to be (or return to be) illuminated with the on indicating color. If, however, the iron 10 is turned off and a temperature of the sole plate 12 is (or becomes) less than a predetermined temperature that causes a temperature indicating color illumination of the water tank 16, the illumination of the water tank 16 will be turned off. In an exemplary embodiment, the lowest predetermined temperature of the sole plate 12 having a corresponding temperature indicating color may be selected such that, if the sole plate 12 is below that temperature, i.e., the water tank 16 of the iron 10 is not illuminated in a temperature indicating color, the iron 10 will be safe to put away.

While specific examples of an iron using color to indicate a state thereof have been described in detail, it will be appreciated by those skilled in the art that various modifications and alternatives to those details could be developed in light of the overall teachings of this disclosure. For example, it will be appreciated that the system and method described herein could also be used to illuminate a translucent water tank of home appliances of any type to indicate an on state and/or temperature state of such home appliances. In this regard, such home appliances could include floor steamers, rug steamers, clothes steamers, etc. and such home appliances would thus include a body having a water tank in fluid communication with a steam outlet, a heater associated with the water tank for heating water within the water tank to thereby produce steam to be issued via the steam outlet, a sensor for sensing a temperature associated with the water tank, e.g., water/steam temperature, a user interface for setting a desired temperature associated with the water tank, a controller in communication with user interface and the sensor for controlling the heater, and an illumination device under the control of the controller for illuminating the water tank in a color that is representative of a temperature state associated with the water tank as sensed by the sensor. Accordingly, the particular arrangements disclosed are meant to be illustrative only and not limiting as to the scope of the invention which is to be given the full breadth of the appended claims and any equivalents thereof.

What is claimed is:

1. A home appliance, comprising:

a body having a translucent water tank in fluid communication with a steam outlet; a heater associated with the water tank for heating water within the water tank to thereby produce steam to be issued via the steam outlet;

a sensor for sensing a temperature associated with the water tank;

a user interface for setting a desired temperature associated with the water tank;

a controller in communication with the user interface and the sensor for controlling the heater; and an illumination device under the control of the controller for illuminating the water tank in a color that is representative of a temperature state associated with the water tank as sensed by the sensor.

2. The home appliance as recited in claim 1, wherein the illumination device illuminates the water tank plural different colors, each of the colors representative of a different temperature state of the water tank.

3. The home appliance as recited in claim 2, wherein the illumination device comprises plural LEDs for illuminating the water tank plural different colors.

4. The home appliance as recited in claim 3, wherein the plural LEDs are positioned adjacent to the water tank for illuminating the interior of the water tank.

5. The home appliance as recited in claim 3, wherein the plural LEDs are positioned within a side wall of the water tank for illuminating the side wall of the water tank.

6. The home appliance as recited in claim 2, wherein the illumination device comprises a single LED for illuminating the water tank plural different colors.

7. The home appliance as recited in claim 6, wherein the LED is positioned adjacent to the water tank for illuminating the interior of the water tank.

8. The home appliance as recited in claim 6, wherein the LED is positioned within a side wall of the water tank for illuminating the side wall of the water tank.

* * * * *